United States Patent [19]

Zeichner

[11] Patent Number: 4,736,996

[45] Date of Patent: Apr. 12, 1988

[54] SHOE DISPLAY AND STORAGE CABINET

[76] Inventor: Norman K. Zeichner, 4229 Nogales Dr., Tarzana, Calif. 91356

[21] Appl. No.: 3,467

[22] Filed: Jan. 15, 1987

[51] Int. Cl.[4] ..... A47B 87/00; A47F 3/00

[52] U.S. Cl. ..... 312/118; 312/198; 312/327

[58] Field of Search ..... 312/324, 327, 114, 118, 312/126, 198, 199

[56] References Cited

U.S. PATENT DOCUMENTS

| | | | |
|---|---|---|---|
| D. 56,263 | 9/1920 | Bailey | 312/118 |
| 587,113 | 7/1897 | Belknap | 312/327 |
| 1,348,461 | 8/1920 | Washington | 312/327 |
| 1,751,107 | 3/1930 | Smith | 312/227 |
| 1,873,140 | 8/1932 | McGaugh | 312/118 |
| 3,249,392 | 5/1966 | Berman | 312/118 |
| 3,828,937 | 8/1974 | Nash | 312/198 |
| 3,995,925 | 12/1976 | Roesler | 312/118 |
| 4,219,248 | 8/1980 | Goldberg | 312/324 |
| 4,383,722 | 5/1983 | Weber | 312/133 |

*Primary Examiner*—Victor N. Sakran

*Attorney, Agent, or Firm*—George R. Repper

[57] ABSTRACT

A shoe display and storage cabinet includes a wall array having a first shoe compartment with a plurality of vertically arranged, substantially horizontal shelves displaying a plurality of half-pairs of shoes. The first compartment includes an open display side exposing the shelves and shoes to view. Also provided is a selectively closable, second shoe compartment horizontally adjacent the first shoe compartment, the second shoe compartment having a plurality of vertically arranged, substantially horizontal shelves corresponding to the shelves of the first compartment. The shelves of the second compartment hold a plurality of shoes that correspond to the shoes of the first compartment and together with the shoes of the first compartment form matching pairs of shoes. The second compartment includes a selectively openable door for covering a side of the second compartment corresponding to the open display side of the first compartment. The door provides access to shoes in the second compartment when open and prevents access to shoes in the second compartment when closed.

10 Claims, 1 Drawing Sheet

SHOE DISPLAY AND STORAGE CABINET

BACKGROUND OF THE INVENTION

1. Field of the Invention

The present invention relates to the field of display and storage of shoes in a shoe store.

2. Description of the Background Art

Traditional shoe stores generally display only one specimen per design or model of shoe with a selection of sizes and perhaps even colors of a particular model in a stock area accessible to employees only. The customer selects a desired model or models, and the employee departs to the stockroom to search for and retrieve the desired shoes in the proper size and/or color, if available. While such traditional methods of retailing shoes can be successful in avoiding theft of shoes since only one of a pair of shoes is on display, the remaining shoes being in the stockroom, theft of other items typically sold in shoe stores, such as handbags, socks and the like, can take place while the store employee is in the stockroom searching for shoes. Furthermore, a great deal of time is wasted by the employee going back and forth to the stockroom to determine if a particular model is available in the size and/or color desired by a customer.

Discount shoe stores typically employ another method for retailing shoes wherein all the pairs of shoes in stock, or at least all sizes in stock, are on display for self-service by the customer. Such self-serve operations greatly reduce or eliminate the need for stockroom space, and customers can immediately determine if the size and color of shoe desired is available and if the fit is comfortable without the necessity of a store employee's help. Thus, the store employees need only operate cash registers to ring up the purchases selected by the customers, with periodic restocking of shelves. Unfortunately, display of large numbers of complete pairs of shoes increases the risk of shoe theft.

There remains a need in the art for shoe display areas that maximize the use of floor space in displaying shoes, while minimizing the amount of stock area required as well as minimizing the risk of theft.

SUMMARY OF THE INVENTION

In accordance with the present invention, a shoe display and storage cabinet comprises a wall array including a first shoe compartment having a plurality of vertically arranged, substantially horizontal shelves displaying a plurality of half-pairs of shoes. The first compartment includes an open display side exposing the shelves and the shoes to view. The wall array includes a selectively closable, second shoe compartment horizontally adjacent the first shoe compartment. The second shoe compartment includes a plurality of vertically arranged, substantially horizontal shelves corresponding to the shelves of the first compartment. The shelves of the second compartment display a plurality of shoes that correspond to the shoes of the first compartment and together with the shoes of the first compartment form matching pairs of shoes. The second compartment includes a selectively openable door on a side of the second compartment corresponding to the display side of the first compartment. The door provides access to shoes in the second compartment when opened, and prevents access to the shoes in the second compartment when closed.

DESCRIPTION OF THE PREFERRED EMBODIMENTS

Figure 1:
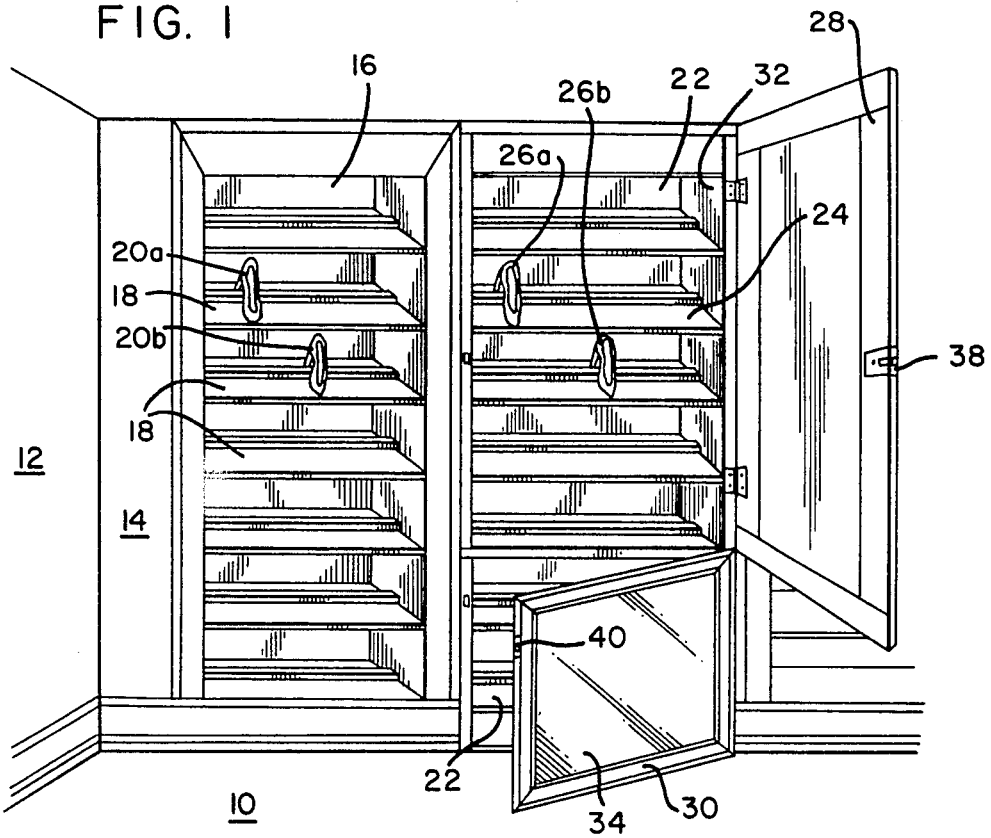
FIG. 1 is a perspective view showing the shoe display and storage cabinet of the invention with locking cabinet compartment sections open.

With reference to the drawings, a shoe display area includes a floor 10 bounded by sidewall portions 12 and 14. Such a shoe display area can be in a shoe store, or in a shoe department of a department store.

The present invention is comprised of a wall array including a first shoe compartment 16 having a plurality of vertically arranged, substantially horizontal shelves 18 displaying a plurality of half-pairs of shoes such as right shoes **20*a* and 20*b*. If desired, shelves 18 can be slightly angled off the horizontal to provide greater visibility of the shoes. A first compartment 16** is provided with a display side open to the shoe display area exposing the shelves and shoes to view.

The wall array according to the invention includes a selectively closeable, second shoe compartment 22 horizontally adjacent the first shoe compartment 16, the second shoe compartment 22 having a plurality of vertically arranged, substantially horizontal shelves 24 corresponding to the shelves of the first compartment. The shelves of the second compartment hold a plurality of shoes such as left shoes **26*a* and 26*b*, that correspond to the shoes 20*a* and 20*b* of the first compartment 16, and together with the shoes 20*a* and 20*b* of the first compartment form matching pairs of shoes 20*a*, 26*a* and 20*b*, 26*b* respectively. The second compartment includes selectively openable, translucent door means split into openable upper and lower door portions 28 and 30 respectively. Door portions 28 and 30 cover a side of the second compartment 22 corresponding to the open display side of the first compartment 16, the door portions 28 and 30 being hinged on a side 32 opposite the first compartment 16. Door portions 28 and 30 provide access to shoes in the second compartment 22 when open and prevents access to the shoes in the second compartment when closed. The lower door portion 30 is comprised of a mirror 34 adjacent the floor 10, so that a customer can easily view shoes when trying them on. The upper door portion 28 need not include a mirror, but may, for example, display an item of clothing such as dress 36 shown in FIG. 2**.

For limiting access to the shoe storage compartment 22, separately operable lock means 38 and 40 are provided for upper and lower door portions 28 and 30 respectively.

Figure 2:
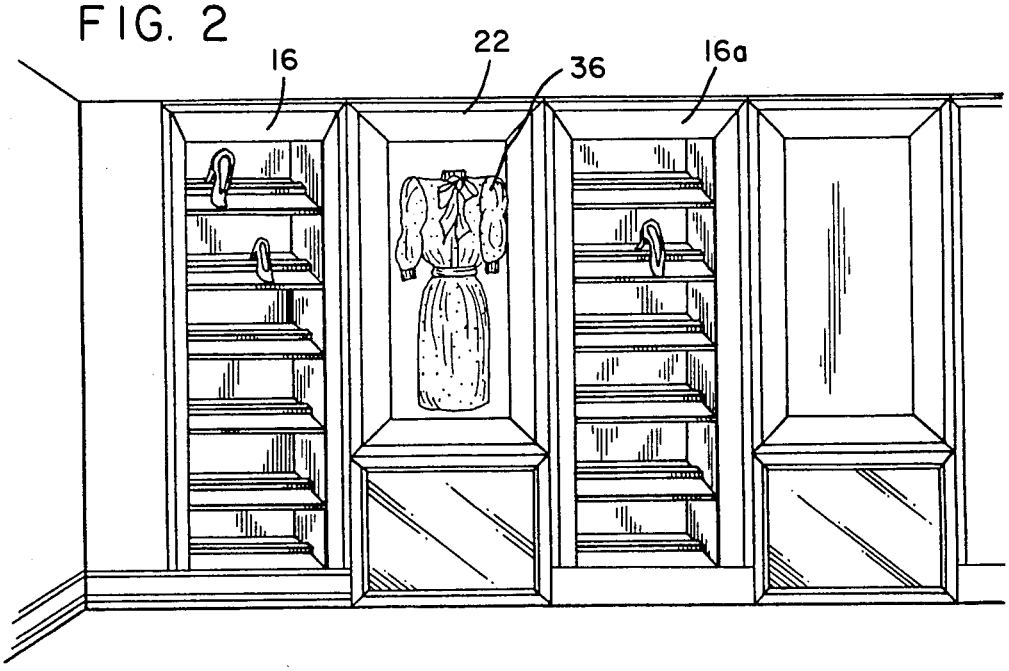
FIG. 2 is a perspective view of a shoe display and storage cabinet according to the invention with locking compartments closed.

As shown in FIG. 2, a shoe display area according to the invention can include a plurality of the abovedescribed wall arrays in side-by-side relation with the open compartment 16 of one array being separated from the open compartment **16*a* of another array by a closable storage compartment 22**.

The present invention provides an attractive display for exhibiting one-half pair of all or nearly all of the pairs of shoes in stock for self-serve try-on by the customer, while securing the other halves of the pairs of shoes in a conveniently adjacent locked compartment. When the customer finds a shoe that fits, the store employee need only open the adjacent locked cabinet, immediately locate the matching shoe kept in the same order as the display shoes, and allow the customer to try on the matching shoe without ever leaving the sales floor. A shoe display according to the present invention provides for elimination of all or nearly all of wasted stock space by displaying all of the sizes and colors in stock for self-service access by customers, while keeping one-half of each pair of shoes locked up to discourage theft. The shoe display of the present invention thus reduces costs and improves profitability over prior art shoe displays by providing a higher sales floor-to-storage space ratio, and by permitting employees to handle a larger number of customers than in traditional shoe stores while maintaining the security of the stock to discourage theft.

Since many modifications, variations and changes in detail may be made to the described embodiments, it is intended that all matter in the foregoing description and shown in the accompanying drawings be interpreted as illustrative and not in a limiting sense.

What is claimed is:

1. A shoe display and storage area having a floor bounded by sidewall portions, with improvements comprising: at least part of said sidewall portions being comprised of a wall array, the wall array including:

(a) a first shoe compartment having a plurality of vertically arranged, substantially horizontal shelves displaying a plurality of half-pairs of shoes, the first compartment having an open display side exposing the shelves and the shoes to view:

(b) a selectively closable, second shoe compartment horizontally adjacent the first shoe compartment, the second shoe compartment having a plurality of vertically arranged, substantially horizontal shelves corresponding to the shelves of the first compartment, the shelves of the second compartment holding a plurality of shoes that correspond to the shoes of the first compartment and together with the shoes of the first compartment form matching pairs of shoes, the second compartment having a selectively openable, translucent door for covering a side of the second compartment corresponding to the display side of the first compartment, said door being hinged on a side of the second compartment opposite the first compartment, the door providing access to shoes in the second compartment when open and preventing access to the shoes in the second compartment when closed; and (c) a lock for selectively locking said door.

2. The shoe display and storage cabinet of claim 1 wherein an outer portion of said door is comprised of a mirror.

3. The shoe display and storage cabinet of claim 5 wherein said door is split into separately openable upper and lower portions.

4. The shoe display and storage cabinet of claim 7 wherein of said upper and lower portions of said door, only the lower portion of the door is comprised of a mirror.

5. The shoe display and storage cabinet of claim 1 wherein said door is split into separately openable upper and lower portions.

6. A shoe display area having a floor bounded by sidewall portions, with improvements comprising: at least part of said sidewall portions being comprised of a wall array, the wall array including:

(a) a first shoe compartment having a plurality of vertically arranged, substantially horizontal shelves displaying a plurality of half-pairs of shoes, the first compartment having an open display side exposing the shelves and the shoes to view;

(b) a selectively closable, second shoe compartment horizontally adjacent the first shoe compartment, the second shoe compartment having a plurality of vertically arranged, substantially horizontal shelves corresponding to the shelves of the first compartment, the shelves of the second compartment holding a plurality of shoes that correspond to the shoes of the first compartment and together with the shoes of the first compartment form matching pairs of shoes, the second compartment having a selectively openable, translucent door for covering a side of the second compartment corresponding to the display side of the first compartment, said door being hinged on a side of the second compartment opposite the first compartment, the door providing access to shoes in the second compartment when open and preventing access to the shoes in the second compartment when closed, at least a portion of said door being comprised of a mirror adjacent said floor; and (c) a lock for selectively locking said door.

7. The shoe display are of claim 6 further including a plurality of said wall arrays in side-by-side relation with the open compartment of one array being separated from the open compartment of another array by a closable compartment.

8. The shoe display area of claim 6 wherein said door is split into openable upper and lower portions, with said lower portion being comprised of a mirror adjacent said floor, said upper and lower portions having separately operable locks.

9. The shoe display area of claim 8 wherein of said upper and lower portions of said door, only said lower portion of said door is comprised of a mirror.

10. A shoe display area having a floor bounded by sidewall portions, with improvements comprising: said sidewall portions being comprised of a plurality of wall arrays, each wall array including:

(a) a first shoe compartment having a plurality of vertically arranged, substantially horizontal shelves displaying a plurality of half-pairs of shoes, the first compartment having an open display side exposing the shelves and the shoes to view;

(b) a selectively closable, second shoe compartment horizontally adjacent the first shoe compartment, the second shoe compartment having a plurality of vertically arranged, substantially horizontal shelves corresponding to the shelves of the first compartment, the shelves of the second compartment holding a plurality of shoes that correspond to the shoes of the first compartment and together with the shoes of the first compartment form matching pairs of shoes, the second compartment having a selectively openable door for covering a side of the second compartment corresponding to the display side of the first compartment, said door being hinged on a side of the second compartment opposite the first compartment, the door providing access to shoes in the second compartment when open and preventing access to the shoes in the second compartment when closed; and (c) a lock for selectively locking said door.

* * * * *